US011028515B2

(12) United States Patent
Lee et al.

(10) Patent No.: US 11,028,515 B2
(45) Date of Patent: Jun. 8, 2021

(54) WASHING MACHINE

(71) Applicant: Samsung Electronics Co., Ltd., Suwon-si (KR)

(72) Inventors: Jin Ho Lee, Suwon-si (KR); Han Kyu Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 216 days.

(21) Appl. No.: 15/913,617

(22) Filed: Mar. 6, 2018

(65) Prior Publication Data

US 2018/0251928 A1 Sep. 6, 2018

(30) Foreign Application Priority Data

Mar. 6, 2017 (KR) ..... 10-2017-0028251

(51) Int. Cl.

| | |
|---|---|
| ***D06F 37/04*** | (2006.01) |
| ***D06F 21/14*** | (2006.01) |
| ***D06F 21/04*** | (2006.01) |
| ***D06F 17/06*** | (2006.01) |
| ***D06F 17/10*** | (2006.01) |
| ***D06F 37/40*** | (2006.01) |

(52) U.S. Cl.

CPC ..... *D06F 37/04* (2013.01); *D06F 17/06* (2013.01); *D06F 21/04* (2013.01); *D06F 21/14* (2013.01); *D06F 17/10* (2013.01); *D06F 37/40* (2013.01)

(58) Field of Classification Search

CPC ..... D06F 17/06; D06F 17/10; D06F 21/04; D06F 21/14; D06F 37/04; D06F 37/40

See application file for complete search history.

(56) References Cited

U.S. PATENT DOCUMENTS

2007/0131001 A1* 6/2007 Lee ..... D06F 37/04 68/140
2007/0137260 A1* 6/2007 Shikamori ..... D06F 17/06 68/3 R
2008/0105003 A1* 5/2008 Ryu ..... D06F 37/225 68/13 R (Continued)

FOREIGN PATENT DOCUMENTS

EP 1759049 B1 8/2016
FR 1227699 A 8/1960

(Continued)

OTHER PUBLICATIONS

European Search Report dated Jul. 2, 2018 in connection with European Patent Application No. 17 21 0029.

(Continued)

*Primary Examiner* — Joseph L. Perrin

(57) ABSTRACT

Disclosed herein is a washing machine provided with a pulsator. The washing machine includes a cabinet, a tub provided in the cabinet to store washing water, a drum rotatably provided in the tub, a pulsator configured to be rotatable independently of the drum and a flange shaft configured to transmit a rotational force to the drum. The drum includes a cylindrical portion configured to form a side surface of the drum, and a rear cover disposed in one side of the cylindrical portion while being disposed in the outside of the pulsator, and seated in the flange shaft.

20 Claims, 18 Drawing Sheets

(56) References Cited

U.S. PATENT DOCUMENTS

| | | | | |
|---|---|---|---|---|
| 2011/0203324 | A1* | 8/2011 | Kim | D06F 37/225 68/139 |
| 2013/0036776 | A1* | 2/2013 | Seo | D06F 37/206 68/18 F |
| 2013/0340180 | A1 | 12/2013 | Shu et al. | |
| 2014/0283563 | A1* | 9/2014 | Hong | D06F 37/145 68/134 |
| 2015/0121968 | A1* | 5/2015 | Kim | D06F 37/24 68/23.2 |

FOREIGN PATENT DOCUMENTS

| | | | |
|---|---|---|---|
| JP | 2005-253567 | A | 9/2005 |
| JP | 2009-247722 | A | 10/2009 |
| KR | 10-2005-0121009 | A | 12/2005 |
| KR | 10-2014-0115157 | A | 9/2014 |
| WO | 2015/131482 | A1 | 9/2015 |

OTHER PUBLICATIONS

Notice of Preliminary Rejection dated Apr. 15, 2021 in connection with Korean Application No. 10-2017-0028251, 11 pages.

* cited by examiner

WASHING MACHINE

CROSS-REFERENCE TO RELATED APPLICATION AND CLAIM OF PRIORITY

This application is related to and claims priority to of Korean Patent Application No. 10-2017-0028251, filed on Mar. 6, 2017, the contents of which are incorporated herein by reference.

TECHNICAL FIELD

Embodiments of the present disclosure relate to a washing machine, more particularly to a washing machine provided with a pulsator.

BACKGROUND

Generally, a washing machine is a machine that washes laundry using power, and types of washing machine include a drum type washing machine which washes laundry by lifting the laundry along an inner circumferential surface of a rotating tub and dropping the laundry when a rotating tub is horizontally disposed and rotates about a horizontal axis in forward and backward directions, and a vertical-axis washing machine which washes laundry using a water flow generated by a pulsator when a rotating tub with the pulsator vertically disposed in the washing machine rotates about a vertical axis in forward and backward directions.

Generally, the drum type washing machine includes a cabinet configured to form an appearance of the drum washing machine, a tub formed in the cabinet to store washing water, a drum rotatably installed in the tub to accommodate laundry, a drive motor disposed in the rear side of the tub to rotate the drum, and a door installed in the front surface of the cabinet. An inlet communicated with the drum is provided in at least one portion of the cabinet, and the door opens and closes and the inlet.

Since a pulsator is not applied to the drum type washing machine, it may be impossible for the drum type washing machine to perform the washing by using the water flow in the same manner as the vertical-axis washing machine.

SUMMARY

To address the above-discussed deficiencies, it is a primary object to provide a washing machine provided with a pulsator.

It is another aspect of the present disclosure to provide a washing machine having an improved support structure of a drum.

It is another aspect of the present disclosure to provide a washing machine provided with a drum having an improved durability.

It is another aspect of the present disclosure to provide a washing machine capable of preventing laundry from being caught on a drum.

Additional aspects of the present disclosure will be set forth in part in the description which follows and, in part, will be obvious from the description, or may be learned by practice of the present disclosure.

In accordance with one aspect of the present disclosure, a washing machine may include a cabinet, a tub provided in the cabinet to store washing water, a drum rotatably provided in the tub, a pulsator configured to be rotatable independently of the drum and a flange shaft configured to transmit a rotational force to the drum. The drum may include a cylindrical portion configured to form a side surface of the drum, and a rear cover disposed in one side of the cylindrical portion while being disposed in the outside of the pulsator, and seated in the flange shaft.

The rear cover may comprise a drum rear surface configured to form a rear surface of the drum, and a seating flange bent from the drum rear surface to be seated in the flange shaft.

The flange shaft may include a flange body coupled to a shaft configured to transmit power from a drive device, a plurality of blades extended radially from the flange body, and a seating member configured to connect the plurality of blades to each other. The seating flange may be seated in at least one of the plurality of blades and the seating member.

The flange shaft may include a seating groove formed in at least one of the plurality of blades and the seating member and into which the seating flange is inserted.

The seating groove may include a first seating groove formed in the plurality of blades and a second seating groove formed in the seating member, wherein the first and second seating groove are formed in a circular shape with respect to the center of rotation of the drum.

The seating flange may include an insertion rib formed to have a greater thickness than a body of the seating flange and configured to be inserted into the seating groove.

The insertion rib may be formed by a hemming structure in which an end portion of the seating flange is folded.

The seating member may connect the plurality of blades to each other and supports the plurality of blades in a circumferential direction.

The plurality of blades and the seating member may be integrally formed.

The seating member may be formed in a ring shape and detachable from the plurality of blades.

The seating flange may include a seating rib formed such that an end portion of the seating flange is bent so as to be in contact with the flange shaft.

The seating flange may form a separation space with an outer circumferential surface of the pulsator to be disposed to face the outer circumferential surface of the pulsator.

The drum rear surface may include a first drum rear surface extended from the cylindrical portion, and a second drum rear surface protruded from the first drum rear surface toward the front side of the drum to be connected to the seating flange, the second drum rear surface disposed in parallel with the front surface of the pulsator.

The flange shaft may include a flange protrusion protruded toward a rear surface of the pulsator, and the pulsator comprises a pulsator groove configured to allow the flange protrusion to be inserted thereto.

The flange protrusion and the pulsator groove may be formed in a circular shape.

In accordance with another aspect of the present disclosure, a washing machine may include a cabinet, a tub provided in the cabinet to store washing water, a drum having a cylindrical portion and a rear cover provided in one side of the cylindrical portion and configured to be rotatably provided in the tub, a pulsator configured to be rotatable independently of the drum and configured to be surrounded by an inner circumferential surface of the rear cover and a flange shaft coupled to the drum to transmit a rotational force to the drum in the rear side of the pulsator and configured to allow the rear cover to be inserted thereinto.

The rear cover may include a drum rear surface configured to form a rear surface of the drum, and a seating flange bent from the drum rear surface to be inserted into the flange shaft.

The flange shaft may include a flange body coupled to a shaft configured to transmit power from a drive device, a plurality of blades extended radially from the flange body, and a seating member configured to connect the plurality of blades to each other. The seating flange may be seated in at least one of the plurality of blades and the seating member.

The flange shaft may include a seating groove formed in at least one of the plurality of blades and the seating member and configured to allow the seating flange to be inserted thereto.

In accordance with still another aspect of the present disclosure, a washing machine may include a cabinet, a tub provided in the cabinet to store washing water, a drum configured to be rotatably provided in the tub with respect to a rotation shaft, and provided with a cylindrical portion, and a rear cover provided in the rear side of the cylindrical portion and extended toward the rotation shaft, a pulsator configured to be rotatable independently of the drum in the drum and disposed in the inner side of the rear cover and a flange shaft provided with a seating groove to which rear cover is inserted, and configured to transmit a rotational force to the drum.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
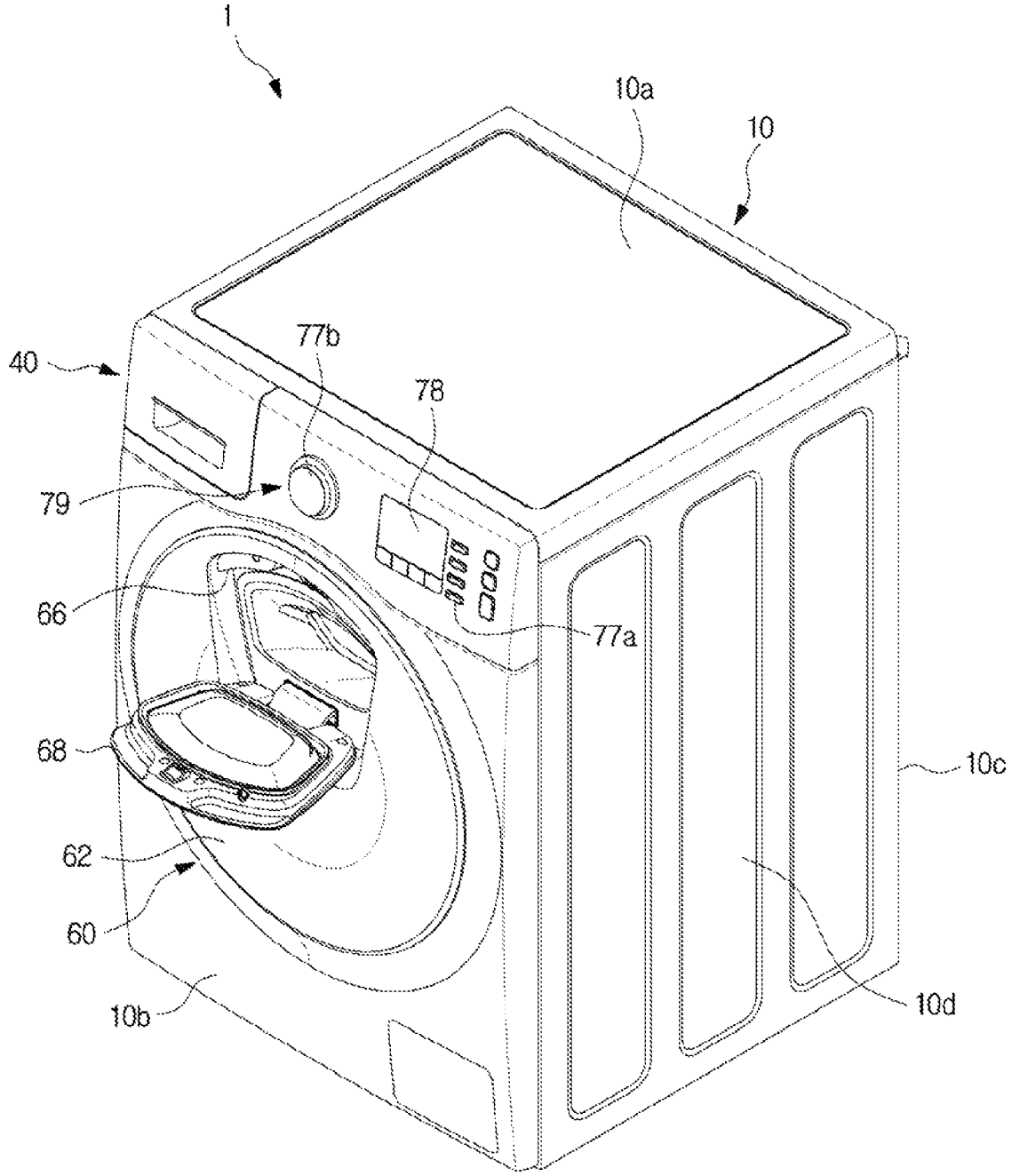
FIG. 1 is a perspective view illustrating a washing machine in accordance with an embodiment of the present disclosure.

FIGS. 1 through 18, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

In addition, the same reference numerals or signs shown in the drawings of the present disclosure indicate elements or components performing substantially the same function.

Also, the terms used herein are used to describe the embodiments and are not intended to limit and/or restrict the present disclosure. The singular forms "a," "an" and "the" are intended to include the plural forms as well, unless the context clearly indicates otherwise. In this present disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the present disclosure, a first element may be termed as a second element, and a second element may be termed as a first element. The term of "and/or" includes a plurality of combinations of relevant items or any one item among a plurality of relevant items.

The present disclosure will be described more fully hereinafter with reference to the accompanying drawings.

Figure 2:
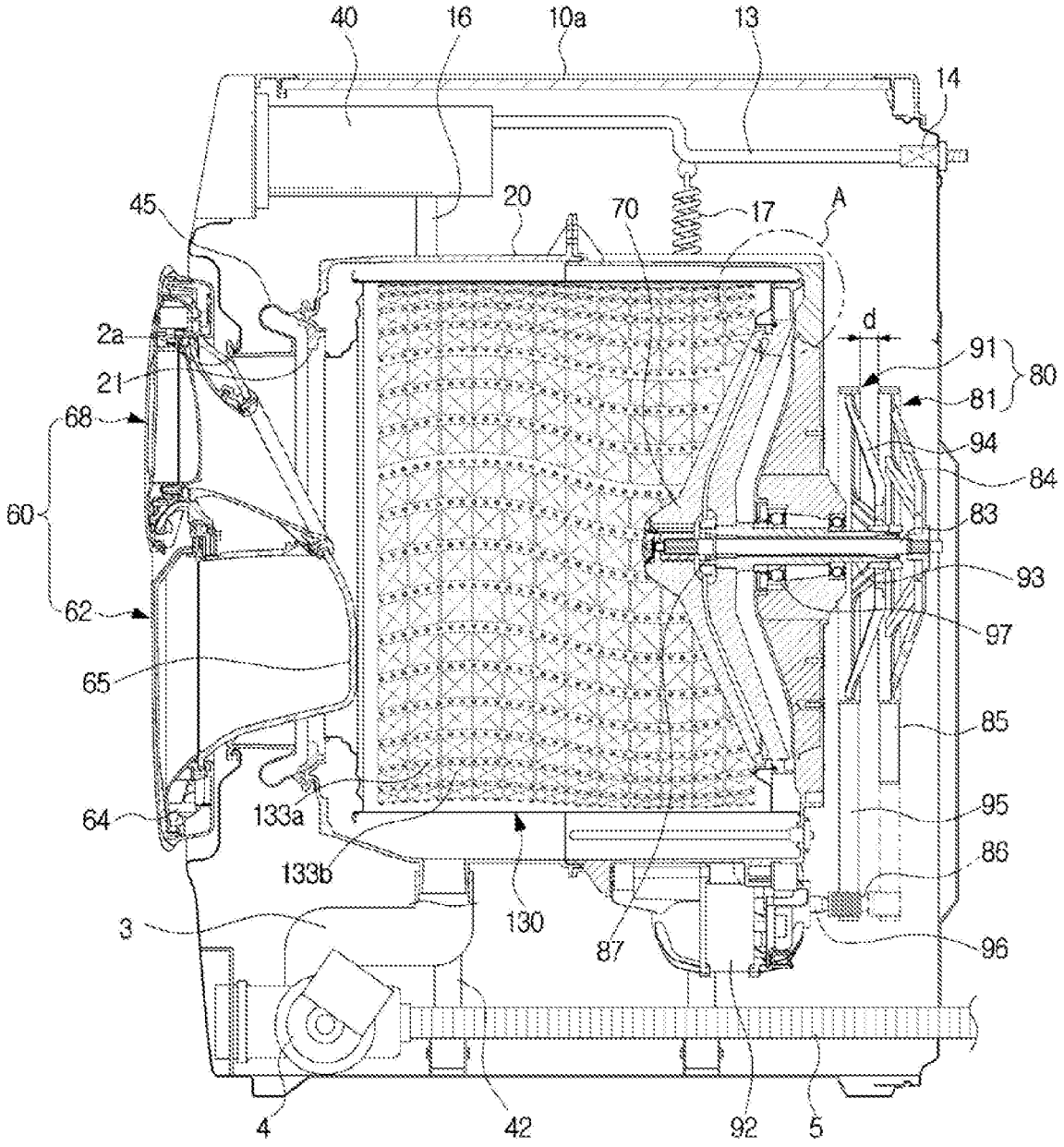
FIG. 2 is a cross-sectional view illustrating the washing machine in accordance with an embodiment of the present disclosure.
Figure 3:
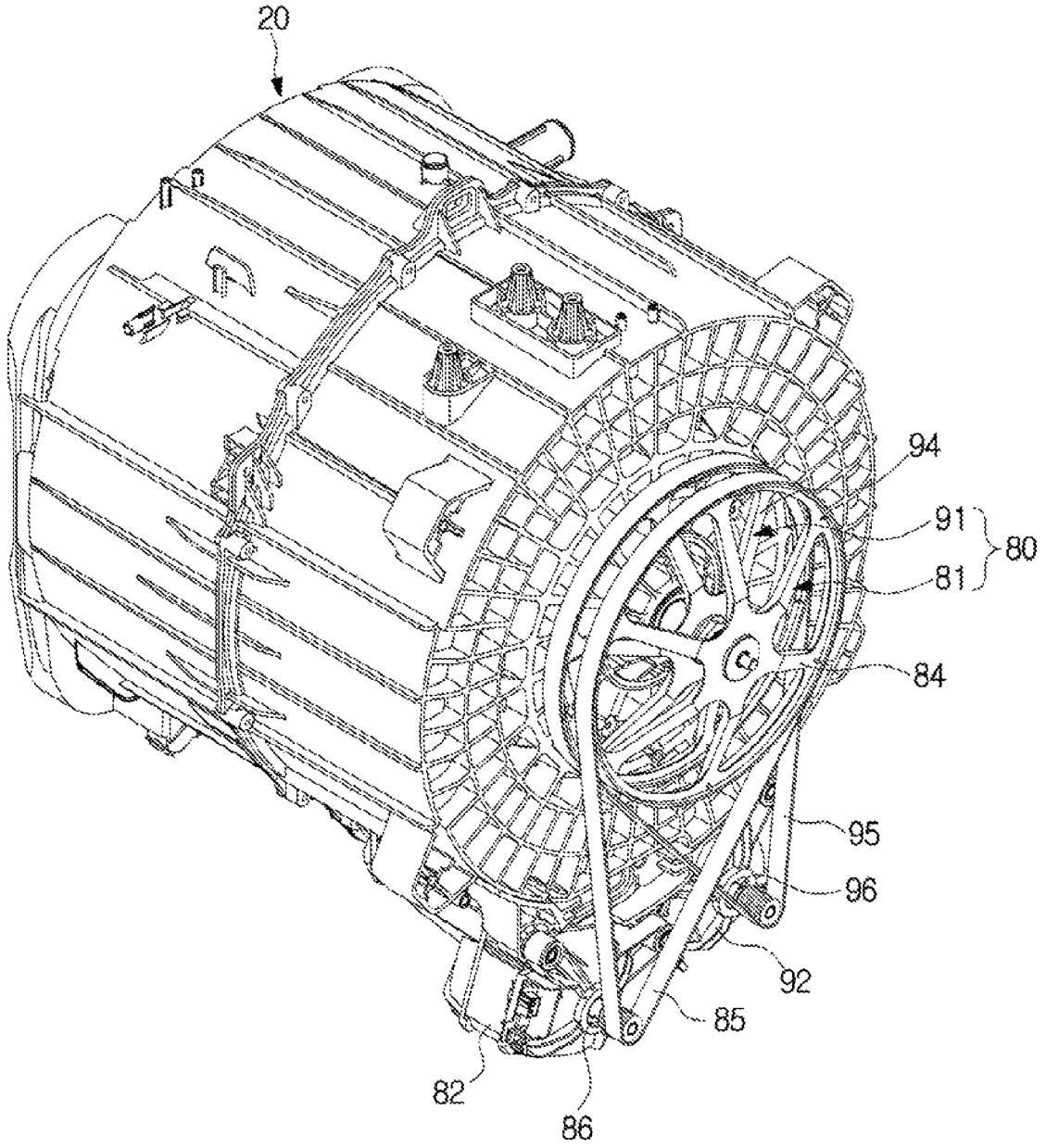
FIG. 3 is a perspective view illustrating a part of the washing machine in accordance with an embodiment of the present disclosure.

FIG. 1 is a perspective view illustrating a washing machine in accordance with an embodiment of the present disclosure, FIG. 2 is a cross-sectional view illustrating the washing machine in accordance with an embodiment of the present disclosure, and FIG. 3 is a perspective view illustrating a part of the washing machine in accordance with an embodiment of the present disclosure.

A washing machine 1 includes a cabinet 10 forming a washing space therein, a tub 20 accommodating washing water or rinse water to be used for washing or rinsing cycle, and a drive device 80 rotating a drum 130. The washing space in the cabinet may be formed by the tub 20 and the drum 130.

The cabinet 10 is provided with a control panel 79 including an input 77*a* and 77*b* configured to receive an operation command of the washing machine 1 from a user and a display 78 configured to display operation information of the washing machine 1.

The input 77*a* and 77*b* receives commands from the user related to the operation of the washing machine 1 such as a washing time, the number of rinsing times, a spin-dry time, a drying time, an operation and a pause, and the input 77*a* and 77*b* may employ a pressure type button 77*a* and a rotation type button 77*b*. The display 78 may display information related to the operation of the washing machine 1 such as an amount of washing water, a cycle that is currently operated, and a period of time that is a remaining time until the washing is completed. The display 78 may employ a Liquid Crystal Display (LCD) panel, or a Light Emitting Diode (LED) panel.

According to an embodiment, in the washing machine 1, the input 77*a* and 77*b*, and the display 78 are separately provided, but is not limited thereto. When the washing machine 1 employs a Touch Screen Panel (TSP), an input and a display may be integrally provided.

The cabinet 10 includes frames 10*a*, 10*b*, 10*c*, and 10*d*. The frames 10*a*, 10*b*, 10*c* and 10*d* are formed of an upper frame 10*a* forming an upper surface of the cabinet, a front frame 10*b* and a rear frame 10*c* forming a front and a rear surface of the cabinet 10, and a side frame 10*d* and a bottom frame connecting the front frame 10*b* to the rear frame 10*c* and forming a side surface and a bottom surface of the cabinet 10.

A first opening 2*a* is formed in the front frame 10*b* of the cabinet 10 to allow laundry to be put into the drum 130. The first opening 2*a* may be opened and closed by a door assembly 60 installed in the front frame 10*b* of the cabinet 10.

A diaphragm 45 may connect the cabinet 10 to the tub 20. Particularly, the diaphragm 45 may be disposed between the first opening 2*a* of the cabinet 10 and an opening 21 of the tub 20 corresponding to the first opening 2*a*. The diaphragm 45 forms a passage from the first opening 2*a* of the cabinet 10 to the opening 21 of the tub 20. The diaphragm 45 may reduce a vibration that is transmitted to the front frame 10*b* upon the rotation of the drum 130.

The diaphragm 45 may be formed of an injection material molded by a thermoplastic elastomer. Since the thermoplastic elastomer has the elasticity like rubber at room temperature, the diaphragm 45 formed of the thermoplastic elastomer may effectively attenuate vibration transmitted from the tub 20 to the front frame of the cabinet 10.

Between the tub 20 and the cabinet 10, a spring 17 may be provided to support the tub 20 from the upper side. By using the elastic force of the spring 17, the spring 17 serves to mitigate vibrations and noise caused by the movement of the tub 20.

A water supply pipe 13 supplying washing water to the tub 20 is installed at an upper portion of the tub 20. A water supply valve 14 is provided at one side of the water supply pipe 13.

A detergent supply device 40 is connected to the tub 20 via a connection pipe 16. Water supplied through the water supply pipe 13 is supplied to the inside of the tub 20 together with the detergent by passing through the detergent supply device 40.

The tub 20 is supported by a damper 42. The damper 42 connects an inner bottom surface of the cabinet 10 to an outer surface of the tub 20. In addition, as well as the inner bottom surface, the damper 42 may be positioned on the upper side, left side, and right side of the cabinet 10 so as to support the tub 20. The damper 42 or the spring 17 may mitigate the vibrations and the shocks caused by the vertical movement of the tub 20 in the upper and lower portions of the tub 20. The tub 20 may be supported by at least one damper 42.

A drain pump 4 configured to discharge the water inside the tub 20 to the outside of the cabinet 10, a connection hose 5 configured to connect the tub 20 to the drain pump 4 to allow the water in the tub 20 to flow into the drain pump 4, and a drain hose 5 configured to guide water, which is pumped by the drain pump 4, to the outside of the cabinet 10 may be provided in a lower portion of the 20.

The door assembly 60 is configured to open and close the first opening 2*a*.

The door assembly 60 may include a door portion 62 provided to correspond to the first opening 2*a* and an auxiliary door 68 rotatably provided in the door portion 62.

The door portion 62 may be rotatable with respect to the cabinet 10. The door portion 62 may include a door body 64 and a door glass 65.

The door body 64 may be provided to form a frame of the door portion 62. In other words, the door body 64 may be provided to correspond to the first opening 2*a*. When the door body 64 is rotated about the cabinet 10, the door assembly 60 may open and close the first opening 2*a*. Therefore, the door body 64 may be formed to correspond to the shape of the first opening 2*a*. According to the embodiment, since the first opening 2*a* is formed in an approximately circular shape, the door body 64 may be formed in a circular shape or a ring shape.

The door portion 62 may include a second opening 66. The second opening 66 may be formed in the door body 64, but is not limited thereto. Alternatively, the second opening 66 may be formed in the door glass 65. The second opening 66 may be opened and closed by an auxiliary door 68 described later, which is performed independently of the first opening 2*a*. Although the first opening 2*a* is closed by the door assembly 60, the second opening 66 may be opened by the auxiliary door 68 so that a user additionally inputs the detergent or laundry to the inside of the washing machine. That is, the second opening 66 may be connected to the inside of the cabinet 10 or the inside of the drum 130.

The door portion 62 may include the door glass 65.

The door glass 65 may be formed of a transparent material so that the inside of the drum 130 can be seen from the outside of the washing machine even when the door assembly 60 is in the closed position. The door glass 65 may be arranged to protrude convexly from the door body 64. With such a configuration, when the door assembly 60 is in the closed position, the door glass 65 may be provided to be more inserted into the cabinet 10 than the first opening 2*a*.

The drum 130 may have a substantially cylindrical shape having a front surface opened and the drum 130 may be rotatably provided inside the tub 20. That is, the drum 130 may include an opening formed in the front surface thereof. The drum 130 may be disposed such that a central axis thereof is parallel to a central axis of the tub 20.

The drum 130 may rotate inside the tub 20. The drum 130 may perform washing by lifting and lowering the laundry while the drum 130 rotates. A plurality of through holes 133*a* may be formed around the drum 130 to allow the washing water stored in the tub 20 to flow. In addition, at least one protrusion 133*b* protruding through the inside of the drum 130 may be provided around the drum 130. When the laundry is washed, the protrusions 133*b* may rub the laundry to improve the washing performance.

In this embodiment, since the drum 130 is not provided with a lifter, the plurality of through holes 133*a* and/or protrusions 133*b* may be continuously formed along the circumferential surface of the drum 130. That is, in the conventional washing machine, since a lifter for lifting the laundry is provided on a part of the inner circumferential surface of the drum 130, a plurality of through holes cannot be continuously formed along the circumferential surface of the drum 130. In other words, in the conventional washing machine, the through hole is not formed in a portion where the lifter is provided. Alternatively, in the case of the washing machine 1 according to the embodiment, since the plurality of through holes 133*a* and/or the protrusions 133*b* are continuously formed along the inner circumferential surface of the drum 130, the washing space may be further secured and the washing water stored in the tub 20 may be further introduced into the drum 130, so that the washing performance can be improved.

A pulsator 70 may be disposed in the inner side of the rear side of the drum 130 and rotatably installed with respect to the drum 130. The pulsator 70 may be configured to be rotatable independently of the drum 130. That is, the pulsator 70 may rotate in the same direction as the drum 130, or may rotate in a different direction from the drum 130. The rotation axis of pulsator 70 may be the same as the rotation axis of drum 130.

The pulsator 70 may include a pulsator body 72 (refer to FIG. 4) and at least one pulsator blade 74 (refer to FIG. 4) formed in a front surface 72*a* of the pulsator body 72. During the washing is performed, the pulsator may generate a water flow in the forward and backward directions inside the drum 130 through the pulsator blade 74. According to an embodiment, it may be possible to improve the washing performance by the pulsator 70.

A drive device 80 including a first drive device 81 configured to supply power to the pulsator 70 and a second drive device 91 configured to supply power to the drum 130 may be provided at the rear side of the tub 20.

The first drive device 81 may include a first drive motor 82 configured to generate a rotational force to rotate the pulsator 70, a first shaft 83 configured to be extended to the rear side from the pulsator 70 to become a rotation axis of the pulsator 70, a first pulley 84 connected to the first shaft 83, and a first belt 85 configured to connect the first drive motor 82 to the first pulley 84.

The first drive motor 82 may be fixed to the outside of the tub 20 and supply power to the pulsator 70. Particularly, the first drive motor 82 may be mounted on a part of the lower end portion of the outer circumferential surface of the tub 20.

The first drive motor 82 may include a first motor shaft 86, wherein the first motor shaft 86 may be configured to be more extended to the rear side of the washing machine 1 than a second motor shaft 96 of a second drive motor 92 described later. By using the above mentioned configuration, the first belt 85 may be arranged so as not to interfere with a second belt 95.

The first drive motor 82 may be a motor capable of forward rotation and reverse rotation. Accordingly, the first drive motor 82 may selectively rotate the pulsator 70 in any one direction of the same direction as a rotation direction of the drum 130 and the opposite direction to the rotation direction of the drum 130. The first drive motor 82 may be a brushless DC (BLDC) motor.

The first shaft 83 may be connected to a back surface of the pulsator 70 and extended from the pulsator 70 along the rotation axis of the pulsator 70. That is, the first shaft 83 may be extended to the rear side of the pulsator 70. The first shaft 83 may become the rotation axis of the pulsator 70. The first shaft 83 may be formed separately from the pulsator 70 and then coupled to the pulsator 70, but is not limited thereto. The first shaft 83 may be integrally formed with the pulsator 70.

A first bearing 87 configured to rotatably support the first shaft 83 may be provided on the outer circumferential surface of the first shaft 83. The first bearing 87 may be fixed to a second shaft 93.

One end of the first shaft 83 may be connected to the pulsator 70 and the other end of the first shaft 83 may be connected to a first pulley 84 described later. By using the structure, the first shaft 83 may transmit the power, which is received from the first drive motor 82 by the first pulley 84, to the pulsator 70 so as to rotate the pulsator 70.

The first shaft 83 may be rotatably inserted into the second shaft 93. Accordingly, the first shaft 83 may rotate in the same direction as the second shaft 93, or may rotate in the opposite direction to the second shaft 93.

Since the first shaft 83 is longer than the second shaft 93, the first shaft 83 may be inserted into the second shaft 93 so as to protrude from both ends of the second shaft 93. According to this configuration, the pulsator 70 connected to one end of the first shaft 83 may be disposed inside the drum 130 connected to one end of the second shaft 93. The first pulley 84 connected to the other end of the first shaft 83 may be more spaced from the drum 130 than the second pulley 94 connected to the other end of the second shaft 93.

The first pulley 84 may receive the power from the first drive motor 82 and transmit the power to the pulsator 70. The first pulley 84 may be disposed to be more spaced from the drum 130 than a second pulley 94 described below.

The first belt 85 may connect the first drive motor 82 and the first pulley 84 to transmit the power of the first drive motor 82 to the first pulley 84. Particularly, the inner surface of the first belt 85 may be brought into contact with and coupled to the first motor shaft 86 of the first drive motor 82 and the first pulley 84. That is, the rotational movement of the first belt 85 may be guided by the first motor shaft 86 of the first drive motor 82 and the first pulley 84.

The first belt 85 may be spaced apart from the second belt 95 by a predetermined distance (d). Accordingly, the second belt 95 may not be interfered with the first belt 85.

The second drive device 91 may include a second drive motor 92 configured to generate a rotational force to rotate the drum 130, a second shaft 92 configured to be extended to the rear side from the drum 130 to become a rotation axis of the drum 130, a second pulley 94 connected to the second shaft 93, and a second belt 95 configured to connect the second drive motor 92 to the second pulley 94.

The second drive motor 92 may be fixed to the outside of the tub 20 and supply the power to the drum 130. Particularly, the second drive motor 92 may be mounted on a part, which is different from a part of the lower end portion of the outer circumferential surface of the tub 20 to which the first drive motor 82 is fixed.

The second drive motor 92 may include a second motor shaft 96, wherein the second motor shaft 96 may be configured to be less extended to the rear side of the cabinet 10 than the first motor shaft 86 of the first drive motor 82. By using the above mentioned configuration, the second belt 95 may be arranged so as not to interfere with the first belt 85.

The second drive motor 92 may be a motor capable of forward rotation and reverse rotation. Accordingly, the second drive motor 92 may rotate the drum 130 in a first direction or a second direction different from the first direction. The second drive motor 92 may be a brushless DC (BLDC) motor that is the same as the first drive motor 82.

According to the embodiment, the second drive motor 92 may be a drive motor the same as the first drive motor 82. Particularly, the second drive motor 92 may be configured to have a driving force the same as the driving force of the first drive motor 82.

The second shaft 93 may be connected to a rear surface of the drum 130 and extended from the drum 130 along the rotation axis of the drum 130. That is, the second shaft 93 may be extended to the rear side of the drum 130. The second shaft 93 may become the rotation axis of the drum 130. The second shaft 93 may penetrate the rear plate of the tub 20 and then connect the drum 130 to the second pulley 94. The second shaft 93 may be formed separately from the drum 130 and then coupled to the drum 130, but is not limited thereto. Alternatively, the second shaft 93 may be integrally formed with the drum 130.

Particularly, the second shaft 93 may be coupled to a flange shaft 100 provided on the rear surface of the drum 130. The flange shaft 100 may be connected to the second shaft 93. The flange shaft 100 may rotate together with the rotation of the second shaft 93. The flange shaft 100 may be configured to be extended radially from the second shaft 93. The flange shaft 100 may be coupled to one side of the drum 130 and thus the rotational force of the second shaft may be transmitted to the drum 130 so that the drum 130 rotates.

A second bearing 97 configured to rotatably support the second shaft 93 may be provided on the outer circumferential surface of the second shaft 93. The second bearing 97 may be fixed to the tub 20.

One end of the second shaft 93 may be connected to the drum 130 and the other end of the second shaft 93 may be connected to the second pulley 94 described later. According to the configuration, the second shaft 93 may transmit the power received from the second drive motor 92 to the drum 130 so as to rotate the drum 130.

In addition, the second shaft 93 may have a hollow therein so that the first shaft 83 is rotatably inserted therein. Particularly, the hollow of the second shaft 93 may be formed to have a certain diameter, which is larger than a diameter of the first shaft 83 by a predetermined size, so that the first shaft 83 can be inserted into the hollow of the second shaft 93 and rotate. According to this configuration, the second shaft 93 may rotate in the same direction as the first shaft 83, or may rotate in the opposite direction to the first shaft 83.

The second shaft 93 may be shorter than the first shaft 83 so that the first shaft 83 protrudes from both ends of the second shaft 93. According to this configuration, the rear plate of the drum 130 connected to one end of the second shaft 93 may be disposed in more rear side than the pulsator 70 connected to one end of the first shaft 83, and the second pulley 94 connected to the other end of the second shaft 93 may be disposed closer to the drum 130 than the first pulley 84 connected to the other end of the first shaft 83.

The second pulley 94 may receive the power from the second drive motor 92 and transmit the power to the drum 130. The second pulley 94 may be disposed closer to the drum 130 than the first pulley 84.

The second belt 95 may connect the second drive motor 92 and the second pulley 94 to transmit the power of the second drive motor 92 to the second pulley 94. Particularly, the inner surface of the second belt 95 may be brought into contact with and coupled to the second motor shaft 96 of the second drive motor 92 and the second pulley 94. That is, the rotational movement of the second belt 95 may be guided by the second motor shaft 96 of the second drive motor 92 and the second pulley 94.

The second belt 95 may be spaced apart from the first belt 85 by a predetermined distance (d). Accordingly, the second belt 95 may not be interfered with the first belt 85.

Figure 4:
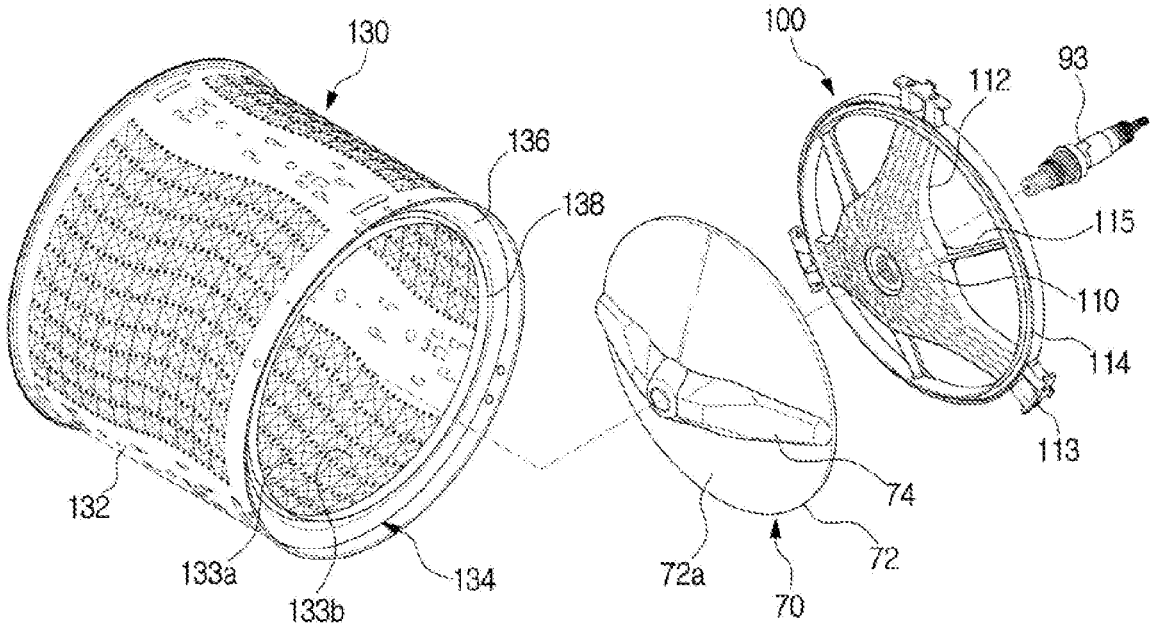
FIG. 4 is an exploded-perspective view illustrating a part of the washing machine in accordance with an embodiment.
Figure 5:
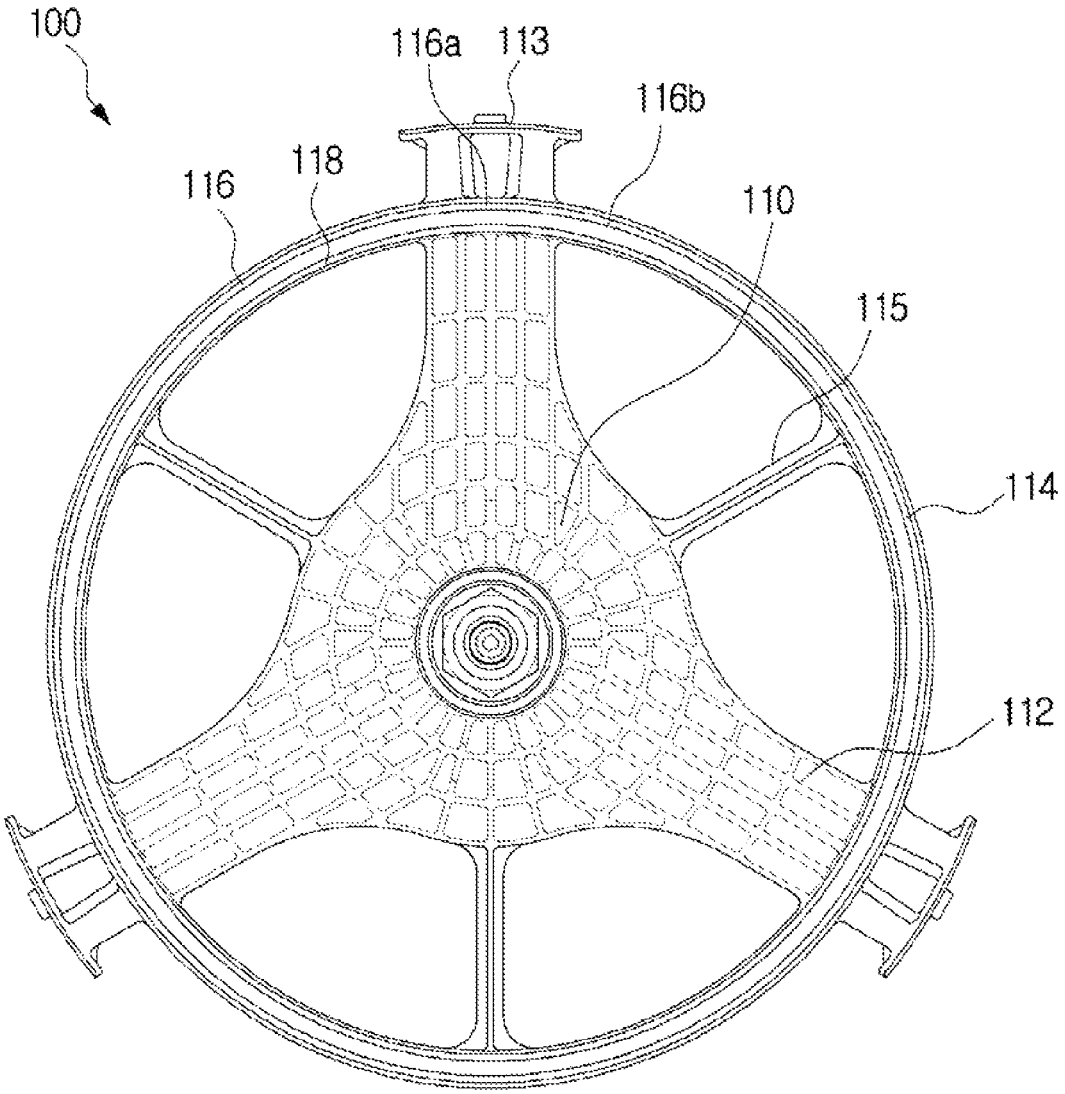
FIG. 5 is a front view illustrating a flange shaft of the washing machine in accordance with an embodiment.
Figure 6:
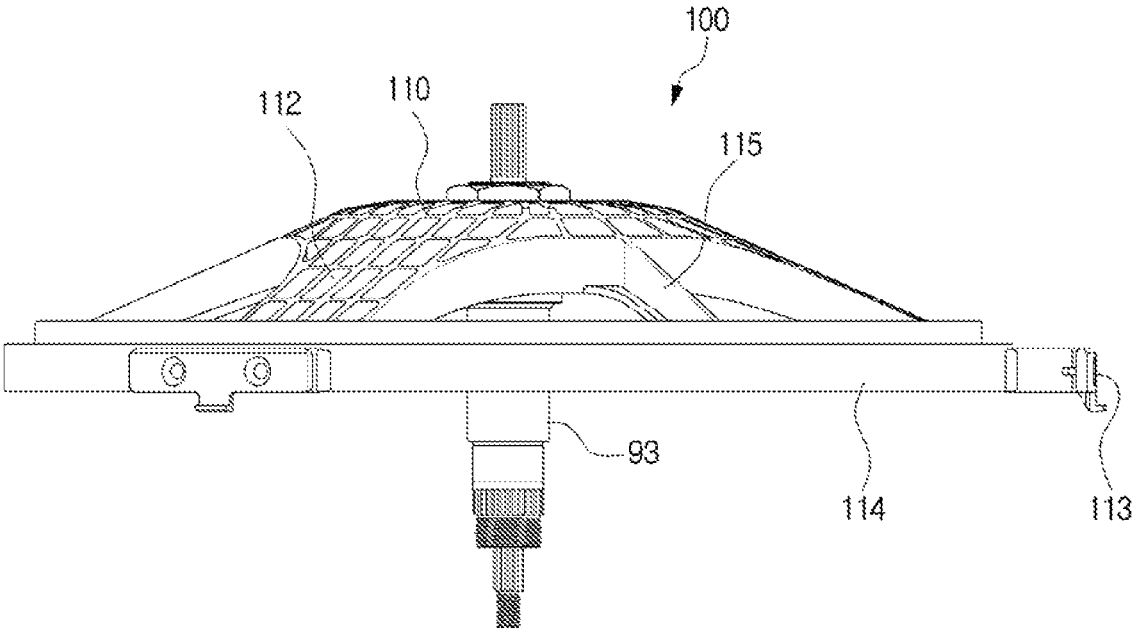
FIG. 6 is a side view illustrating the flange shaft of the washing machine in accordance with an embodiment.
Figure 7:
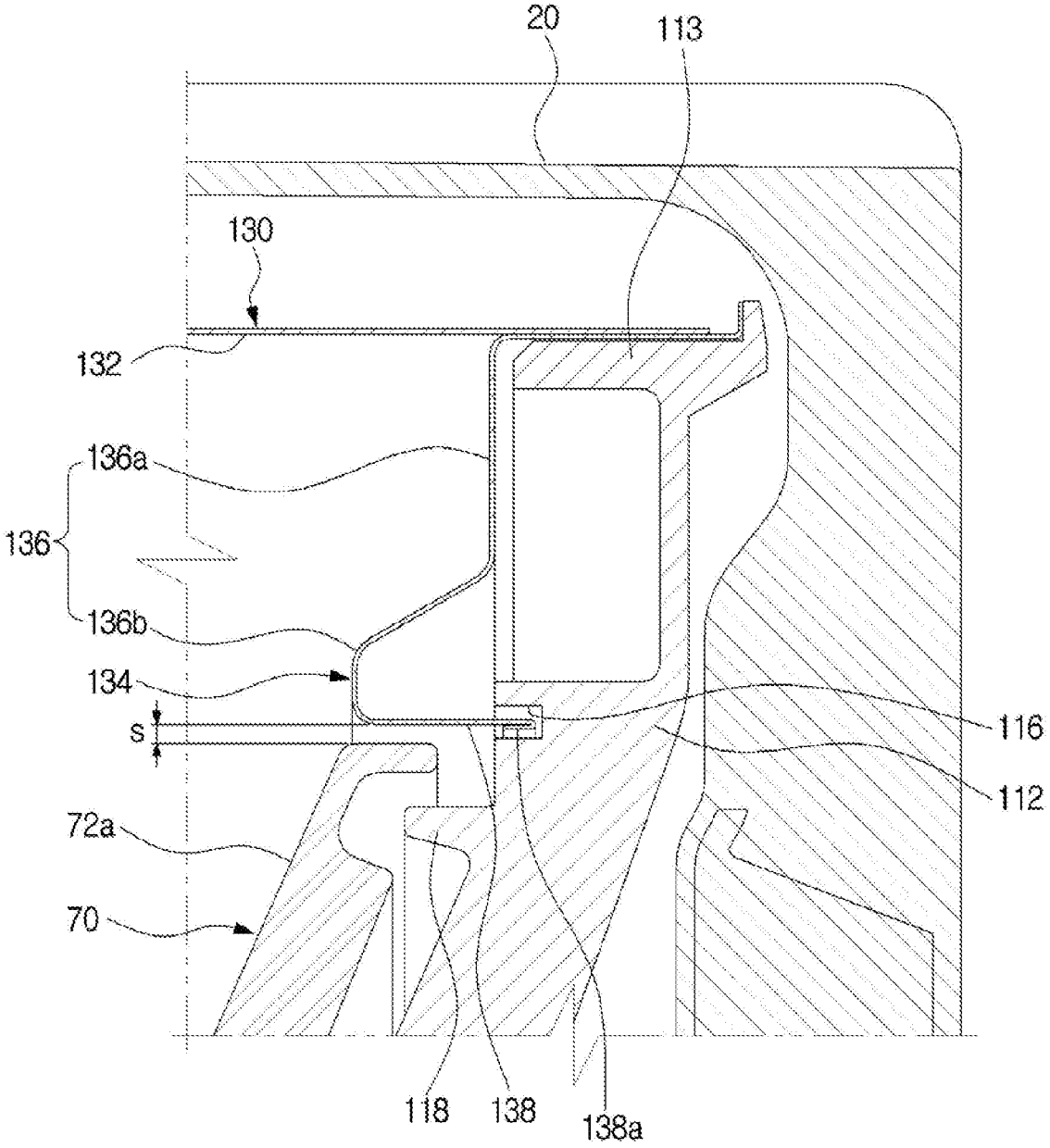
FIG. 7 is an enlarged view illustrating A of FIG. 2.

FIG. 4 is an exploded-perspective view illustrating a part of the washing machine in accordance with an embodiment, FIG. 5 is a front view illustrating a flange shaft of the washing machine in accordance with an embodiment, FIG. 6 is a side view illustrating the flange shaft of the washing machine in accordance with an embodiment, and FIG. 7 is an enlarged view illustrating A of FIG. 2.

The drum 130 may be rotatably provided inside the tub 20. The drum 130 may be configured such that its center of rotation coincides with the center of rotation of the tub 20. The drum 130 may include a cylindrical portion 132 and a rear cover 134.

The cylindrical portion 132 may be provided to form a side surface of the drum 130. The cylindrical portion 132 may be provided with a plurality of through holes 133*a* and/or protrusions 133*b* as described above.

The rear cover 134 may be provided on one side of the cylindrical portion 132. The rear cover 134 may form the rear surface of the drum 130. The rear cover 134 may be provided at the rear of the cylindrical portion 132 and extended toward the rotation axis. The rear cover 134 may be disposed along the circumference of the pulsator 70. That is, the rear cover 134 is disposed apart from the radius of rotation of the pulsator 70, so that interference between the pulsator 70 and the rear cover 134 can be prevented. The rear cover 134 may be configured to be seated in the flange shaft 100 supporting the drum 130. That is, the rear cover 134 may be coupled to the flange shaft 100.

The flange shaft 100 may include a flange body 110 and a plurality of blades 112. The flange body 110 may be coupled to the second shaft 93. The flange body 110 may be integrally formed with the second shaft 93. A plurality of blades 112 may be formed to be extended radially from the flange body 110. In this embodiment, the plurality of blades 112 is provided such that three blades 112 are spaced apart at equal intervals. However, the number or the arrangement of the plurality of blades 112 is not limited thereto.

The plurality of blades 112 may include a coupling portion 113 formed in an end portion of the blade to be coupled to the drum 130. The coupling portion 113 may be coupled to the drum 130 through a screw connection. Particularly, the coupling portion 113 may be coupled to the cylindrical portion 132 of the drum 130. However, the coupling method of the coupling part 113 and the drum 130 is not limited thereto.

When the second shaft 93 is rotated by the drive device 80, a rotational force may be transmitted to the flange shaft 100 coupled to the second shaft 93 and then the rotational force may be transmitted to the drum 130 connected to the flange shaft 100.

The flange shaft 100 may include a seating member 114.

The seating member 114 is provided to connect the plurality of blades 112 to each other. The seating member 114 may be formed in a substantially ring shape. Since the seating member 114 is provided to connect the plurality of blades 112 to each other, the seating member 114 may support the plurality of blades 112 in the circumferential direction. That is, the seating member 114 may stably support the plurality of blades 112 in the circumferential direction. In this embodiment, the plurality of blades 112 and the seating member 114 are integrally formed, but is not limited thereto. Alternatively, the seating member 114 may be configured to be detachable from the plurality of blades 112. The flange shaft 100 may further include a connecting member 115. The connecting member 115 may be extended radially from the flange body 110 and may connect the flange body 110 to the seating member 114. The connecting member 115 may stably support the seating member 114.

The flange shaft 100 may include a seating groove 116.

The seating groove 116 may be configured to allow one side of the above-described rear cover 134 to be seated. The seating groove 116 may be formed in at least one of the plurality of blades 112 and the seating member 114. The seating groove 116 may include first and second seating grooves 116*a* and 116*b*. The first seating groove 116*a* may be formed in the plurality of blades 112 and the second seating groove 116*b* may be formed in the seating member 114. The first and second seating grooves 116*a* and 116*b* may be formed in a circular shape with respect to the center of rotation of the drum 130.

The rear cover 134 may include a drum rear surface 136 and a seating flange 138.

The drum rear surface 136 may be provided to be extended from the cylindrical portion 132 of the drum 130 toward the pulsator 70. The drum rear surface 136 together with the pulsator 70 may form the rear face of the drum 130. The drum rear surface 136 may be formed around the pulsator 70.

The drum rear surface 136 may include a first drum rear surface 136*a* extended from the cylinder and a second drum rear surface 136*b* bent from the first drum rear surface 136*a*. The second drum rear surface 136*b* may be extended from the first drum rear surface 136*a* to protrude toward the inside of the drum 130. The seating flange 138 may be extended from the second drum rear surface 136*b*. The second drum rear surface 136*b* may protrude from the rear surface of the drum 130 to have a height corresponding to the front surface 72*a* of the pulsator 70. The second drum rear surface 136*b* may be disposed in parallel to the front surface 72*a* of the pulsator 70. That is, the second drum rear surface 136*b* and the front surface 72*a* of the pulsator 70 may be formed to prevent a step portion. With this configuration, it is possible to prevent the laundry from being caught between the pulsator 70 and the rear cover 134. In addition, the first and second drum rear surfaces 136*a* and 136*b* are formed to be inclined so that the force applied to the rear cover 134 by laundry or the like may be dispersed.

The seating flange 138 may be bent from the drum rear surface 136 and then seated in the flange shaft 100. The seating flange 138 may be bent rearward from the drum rear surface 136. The seating flange 138 may be formed in an approximately ring-shape.

The inner surface of the seating flange 138 may be formed to face the radial outer circumferential surface of the pulsator 70. When a space between an inner surface of the seating flange 138 and an outer circumferential surface of the pulsator 70 is referred to as a separation space (S), the separation space (S) may become an minimum interval to prevent the laundry from being introduced thereinto while the pulsator 70 is not interfered with the seating flange 138 when the pulsator 70 rotates.

The seating flange 138 may include an insertion rib 138*a*.

The insertion rib 138*a* may be formed at the end of the seating flange 138, and the insertion rib 138*a* may be configured to be inserted into the seating groove 116 of the flange shaft 100. The seating groove 116 may be formed in an approximately circular shape, and the insertion rib 138*a* may be formed in an approximately ring shape by corresponding to the shape of the seating groove 116.

The insertion rib 138*a* may be configured to have a greater thickness than the seating flange 138. With this configuration, the insertion rib 138*a* may be firmly inserted and fixed in the seating groove 116. For example, the insertion rib 138*a* may be formed in a hemming structure at an end portion of the seating flange 138. That is, the insertion rib 138*a* may be formed such that an end portion of the seating flange 138 is overlapped by being folded by 180 degree.

Since the rear cover 134 may be positioned in the radial direction from the outer circumferential surface of the pulsator 70, the pulsator 70 may be not interfered with the rear cover 134 even though the pulsator 70 is rotated in a direction different from the drum 130. In addition, the rear cover 134 may disperse the force, which is applied to the rear cover 134 by the laundry upon the washing, to the cylindrical portion 132 or the flange shaft 100 so as to prevent the deformation.

The flange shaft 100 may include a flange protrusion 118.

The flange protrusion 118 may protrude toward the rear side of the pulsator 70. The pulsator 70 may include a pulsator groove 76 in which the flange protrusion 118 is inserted into the rear surface of the pulsator 70. When the pulsator 70 and the drum 130 are installed with respect to the same rotation axis, the flange protrusion 118 may be inserted into the pulsator groove 76. The flange protrusion 118 and the pulsator groove 76 may prevent the foreign material or the laundry inside the drum 130 from entering into the rear side of the pulsator 70. The flange protrusion 118 may be spaced apart from the inner surface of the pulsator groove 76 by a predetermined distance so that the rotation of the pulsator 70 is not interfered with the flange protrusion 118.

Hereinafter a washing machine according to another embodiment will be described.

In the following description, a description of the same components as those of the above mentioned configuration will be omitted.

Figure 8:
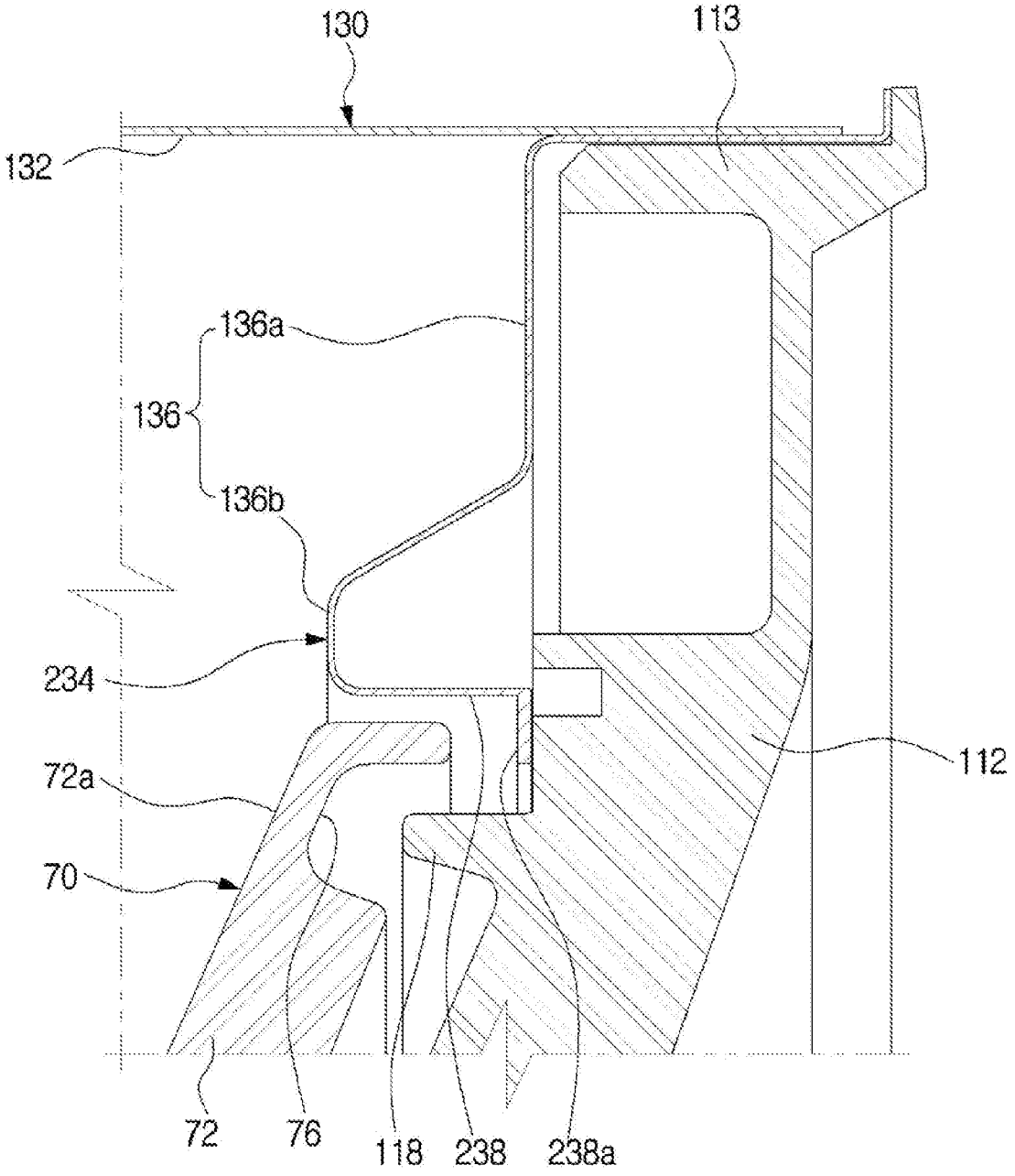
FIG. 8 is a cross-sectional view illustrating a part of the washing machine in accordance with another embodiment.

FIG. 8 is a cross-sectional view illustrating a part of the washing machine in accordance with another embodiment.

A rear cover 234 may include a drum rear surface 136 and a seating flange 238.

The seating flange 238 may be bent from the drum rear surface 136 and then seated in a flange shaft 100. The seating flange 238 may be bent rearward from the drum rear surface 136. The seating flange 238 may be formed in an approximately ring-shape.

An inner surface of the seating flange 238 may be formed to face the radial outer circumferential surface of the pulsator 70. When a space between an inner surface of the seating flange 238 and an outer circumferential surface of the pulsator 70 is referred to as a separation space (S), the separation space (S) may be an minimum interval to prevent the laundry from being introduced thereinto while the pulsator 70 is not interfered with the seating flange 238 when the pulsator 70 rotates.

The seating flange 238 may include a seating rib 238*a*.

The seating rib 238*a* may be formed at the end of the seating flange 238, and the seating rib 238*a* may be bent from a body portion of the seating flange 238. According to an embodiment, the seating rib 238*a* may be bent from the body portion of the seating flange 238 in a rotation center direction of the drum 130, but is not limited thereto. Alternatively, the seating rib 238*a* may be bent in a radial direction from the center of the rotation.

The seating rib 238*a* may be in contact with or be fixed to the flange shaft 100. The seating rib may be formed in a substantially ring-shape. Force applied to the rear cover 234 may be distributed over the contact area between the seating rib 238*a* and the flange shaft 100, and thus it is possible to improve the durability of the rear cover 234.

Hereinafter a washing machine according to another embodiment will be described.

In the following description, a description of the same components as those of the above mentioned configuration will be omitted.

Figure 9:
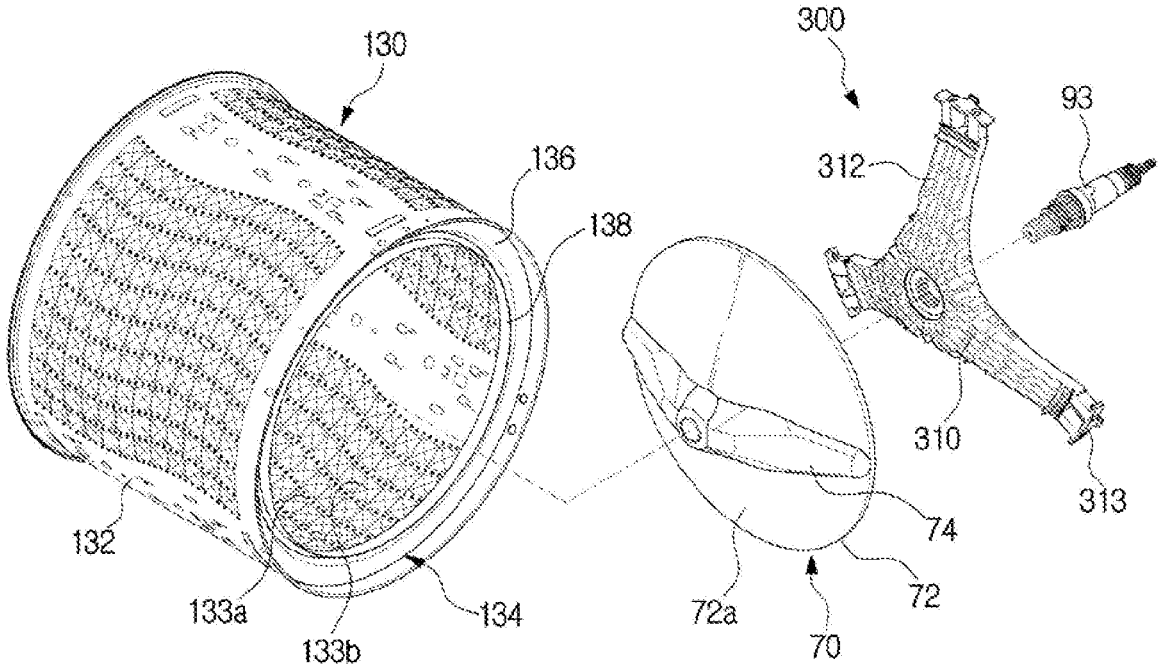
FIG. 9 is an exploded-perspective view illustrating a part of a washing machine in accordance with another embodiment.
Figure 10:
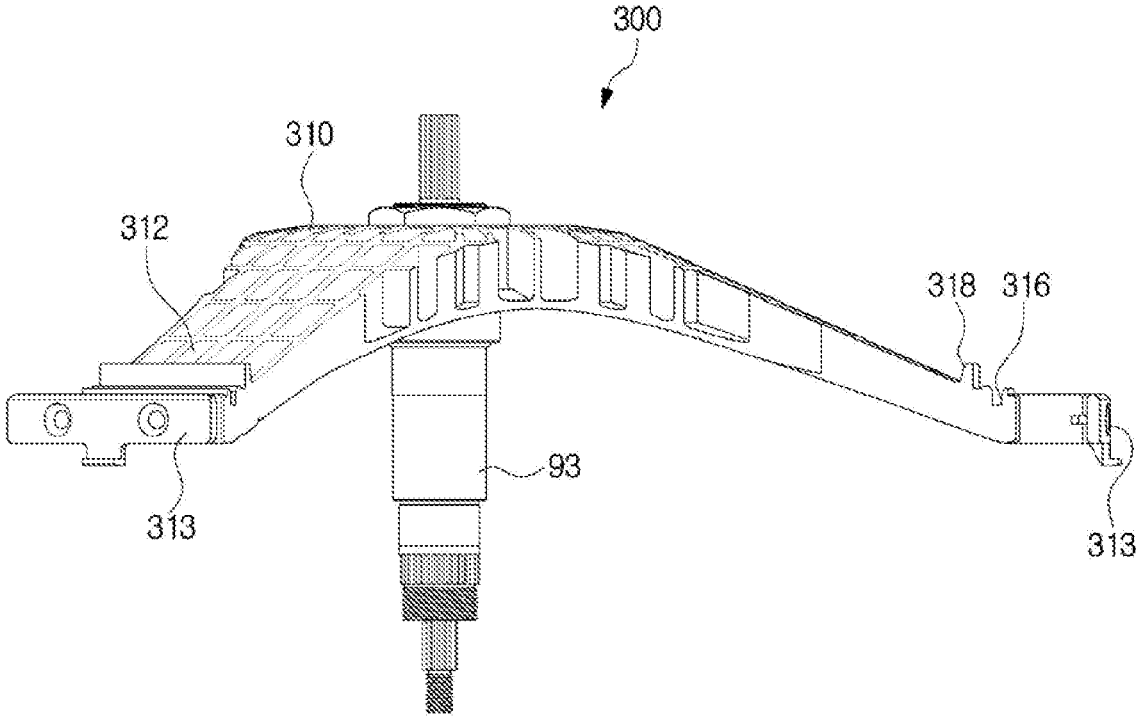
FIG. 10 is a view illustrating a flange shaft of the washing machine in accordance with another embodiment.
Figure 11:
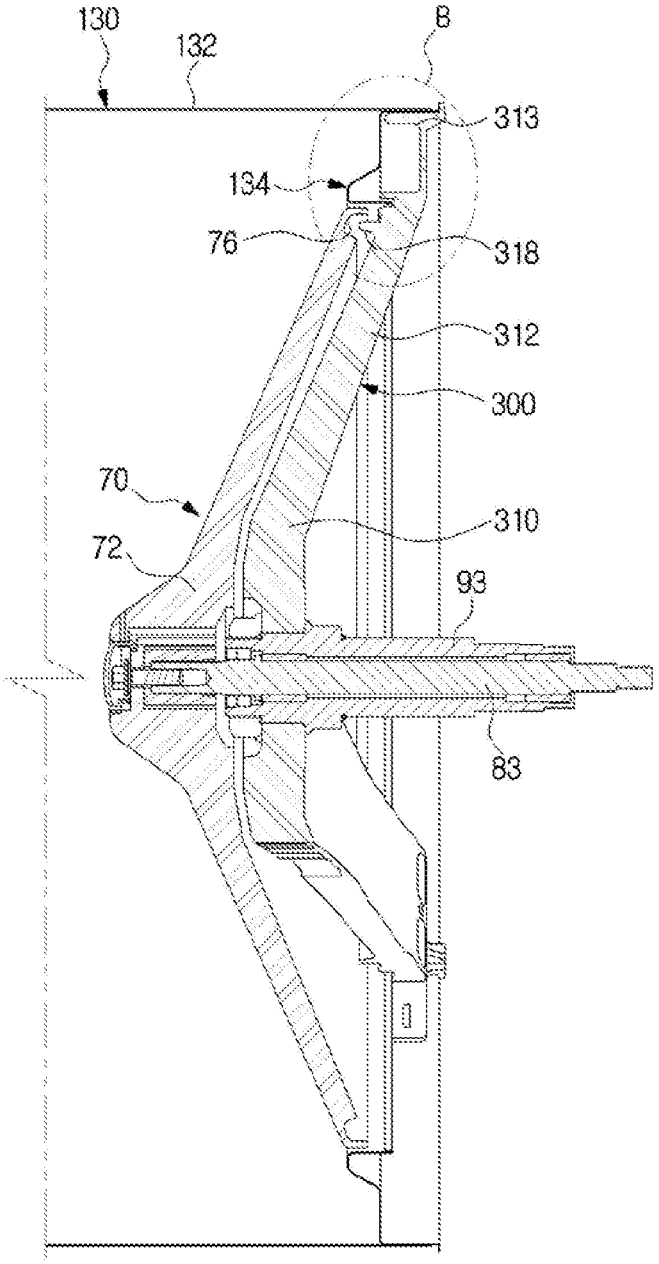
FIG. 11 is a view illustrating coupling of a drum, the flange shaft, and a pulsator of the washing machine in accordance with another embodiment.
Figure 12:
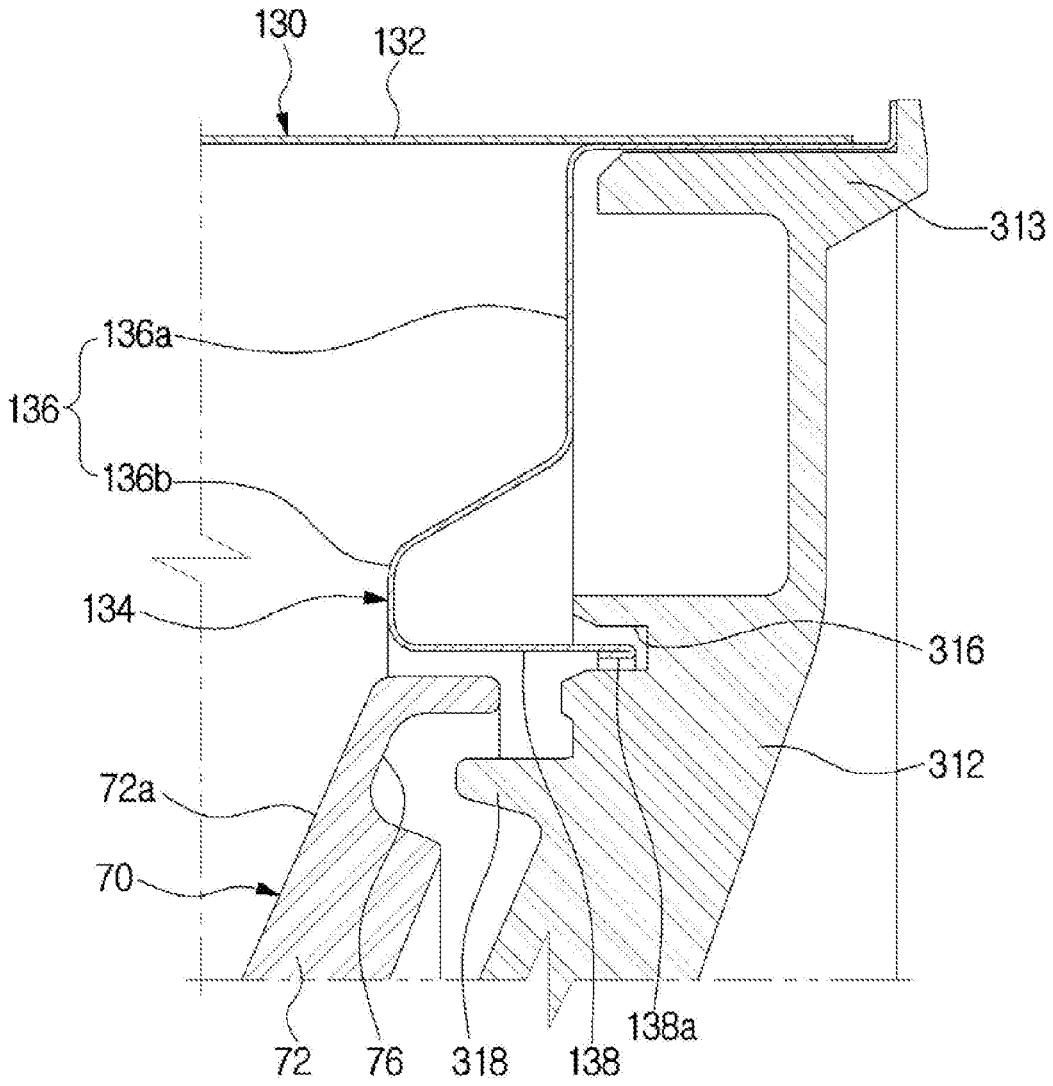
FIG. 12 is an enlarged view illustrating B of FIG. 11.

FIG. 9 is an exploded-perspective view illustrating a part of a washing machine in accordance with another embodiment, FIG. 10 is a view illustrating a flange shaft of the washing machine in accordance with another embodiment, FIG. 11 is a view illustrating coupling of a drum, the flange shaft, and a pulsator of the washing machine in accordance with another embodiment, and FIG. 12 is an enlarged view illustrating B of FIG. 11.

A flange shaft 300 may include a flange body 310, and a plurality of blades 312.

The plurality of blades 312 may include a coupling portion 313 formed in an end portion of the blade to be coupled to the drum 130. The coupling portion 313 may be coupled to the drum 130 by using a screw, but the coupling method of coupling portion 313 and the drum 130 is not limited thereto The flange shaft 300 may include a seating groove 316.

The seating groove 316 may allow one side of the rear cover 134 to be seated thereon. The seating groove 316 may be formed in the plurality of blades 312. An insertion rib 138*a* of the rear cover 134 may be inserted into the seating groove 316 formed in a plurality of blades 312 so that the rear cover 134 is firmly fixed. The flange shaft 300 may include a flange protrusion 318.

Hereinafter a washing machine according to another embodiment will be described.

In the following description, a description of the same components as those of the above mentioned configuration will be omitted.

Figure 13:
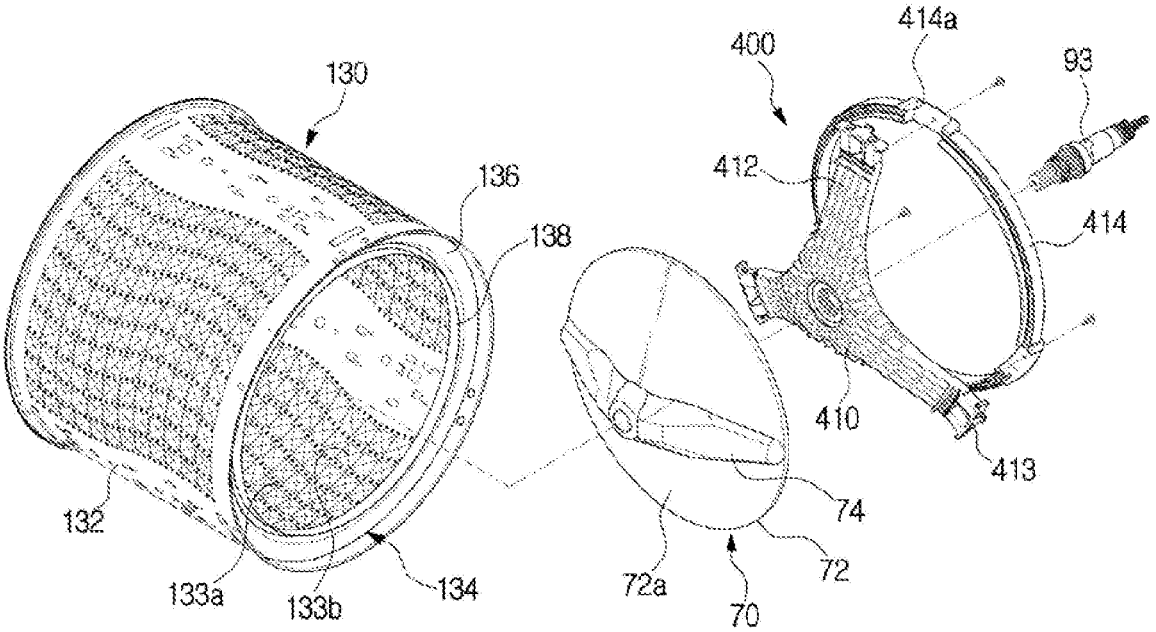
FIG. 13 is an exploded-perspective view illustrating a part of a washing machine in accordance with another embodiment.
Figure 14:
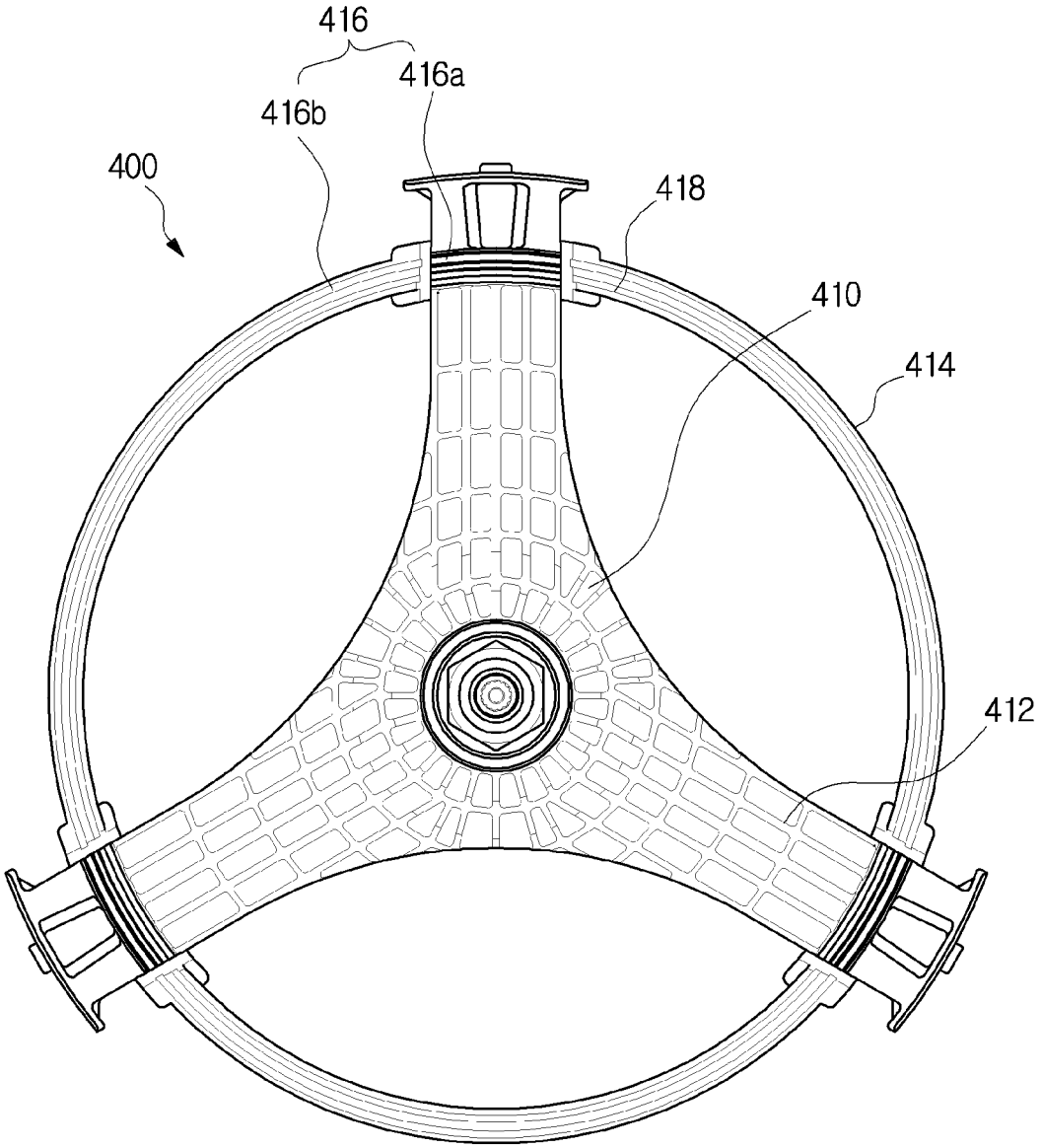
FIGS. 14 and 15 are views illustrating a flange shaft of the washing machine in accordance with another embodiment.
Figure 15:
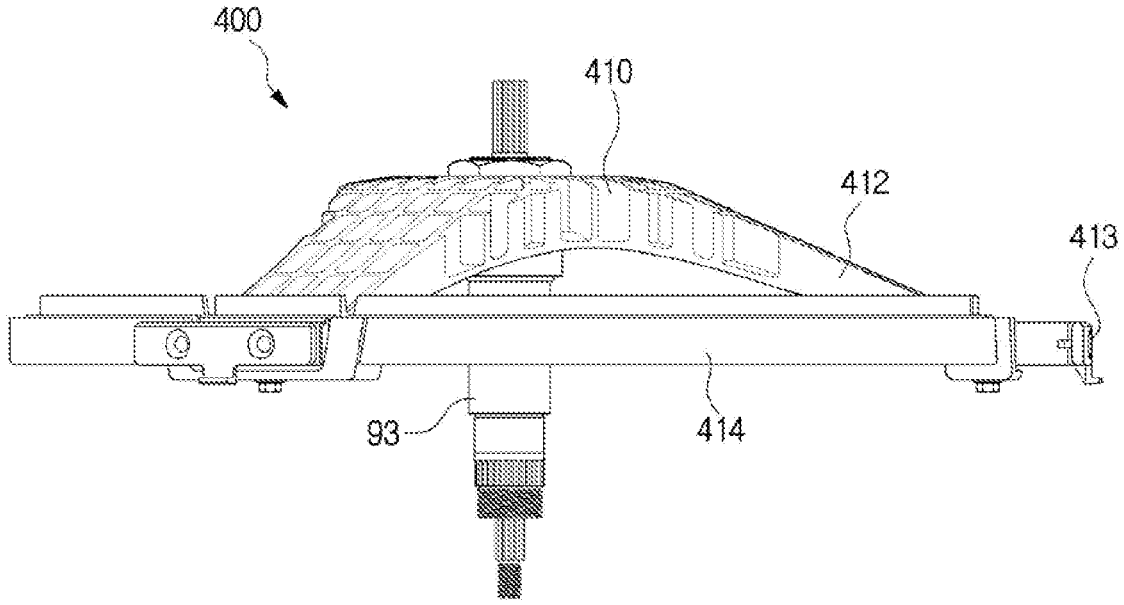
Figure 16:
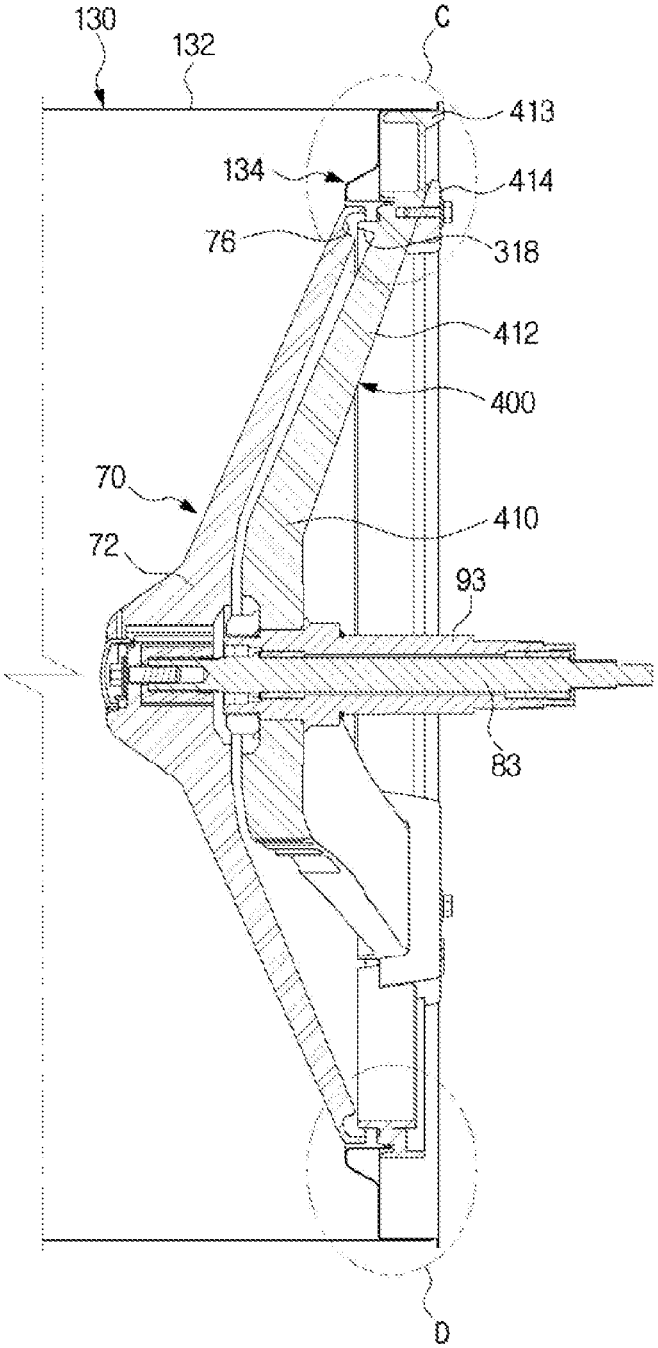
FIG. 16 is a view illustrating coupling of a drum, the flange shaft, and a pulsator of the washing machine in accordance with another embodiment.
Figure 17:
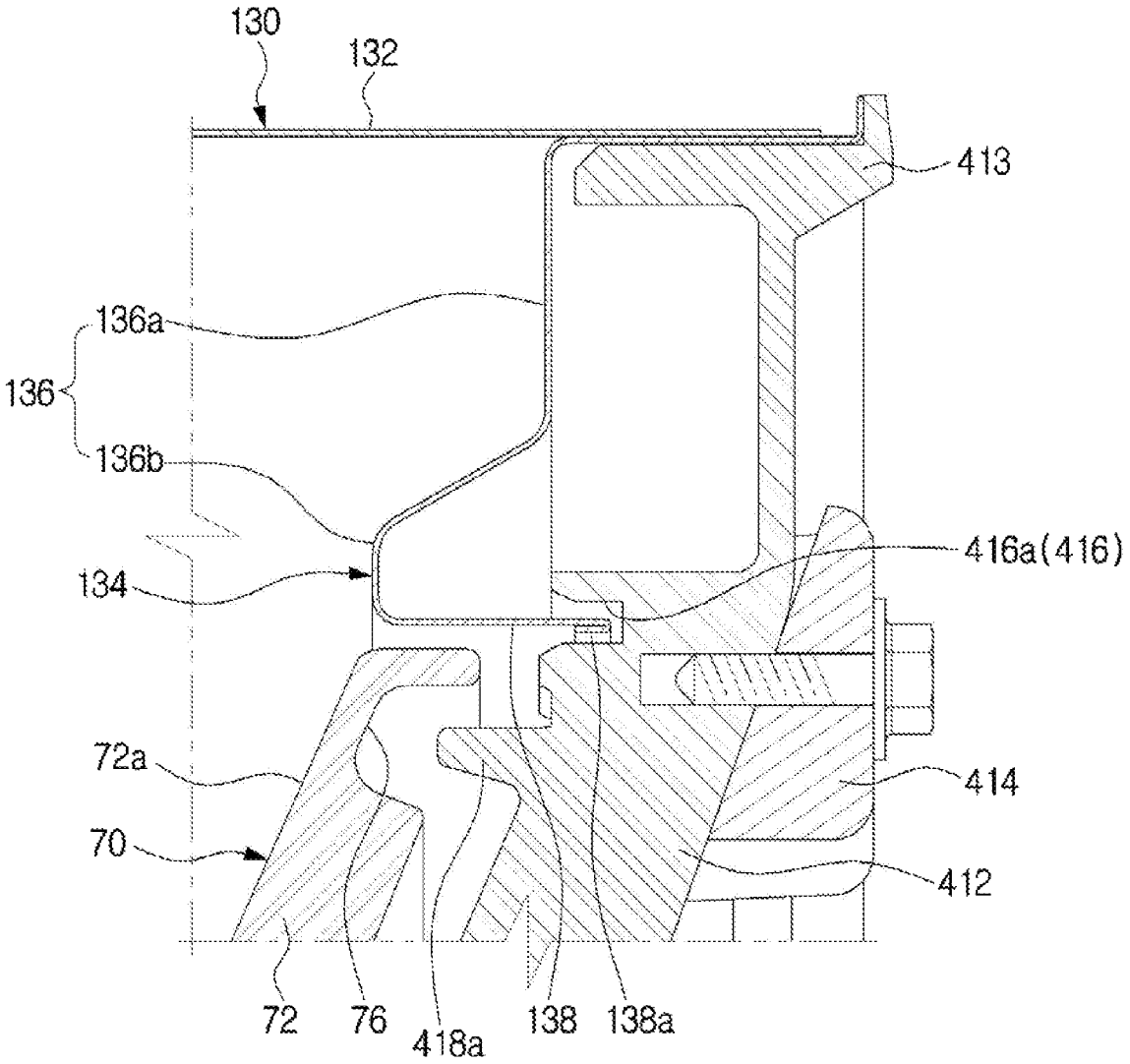
FIG. 17 is an enlarged view illustrating C of FIG. 16.
Figure 18:
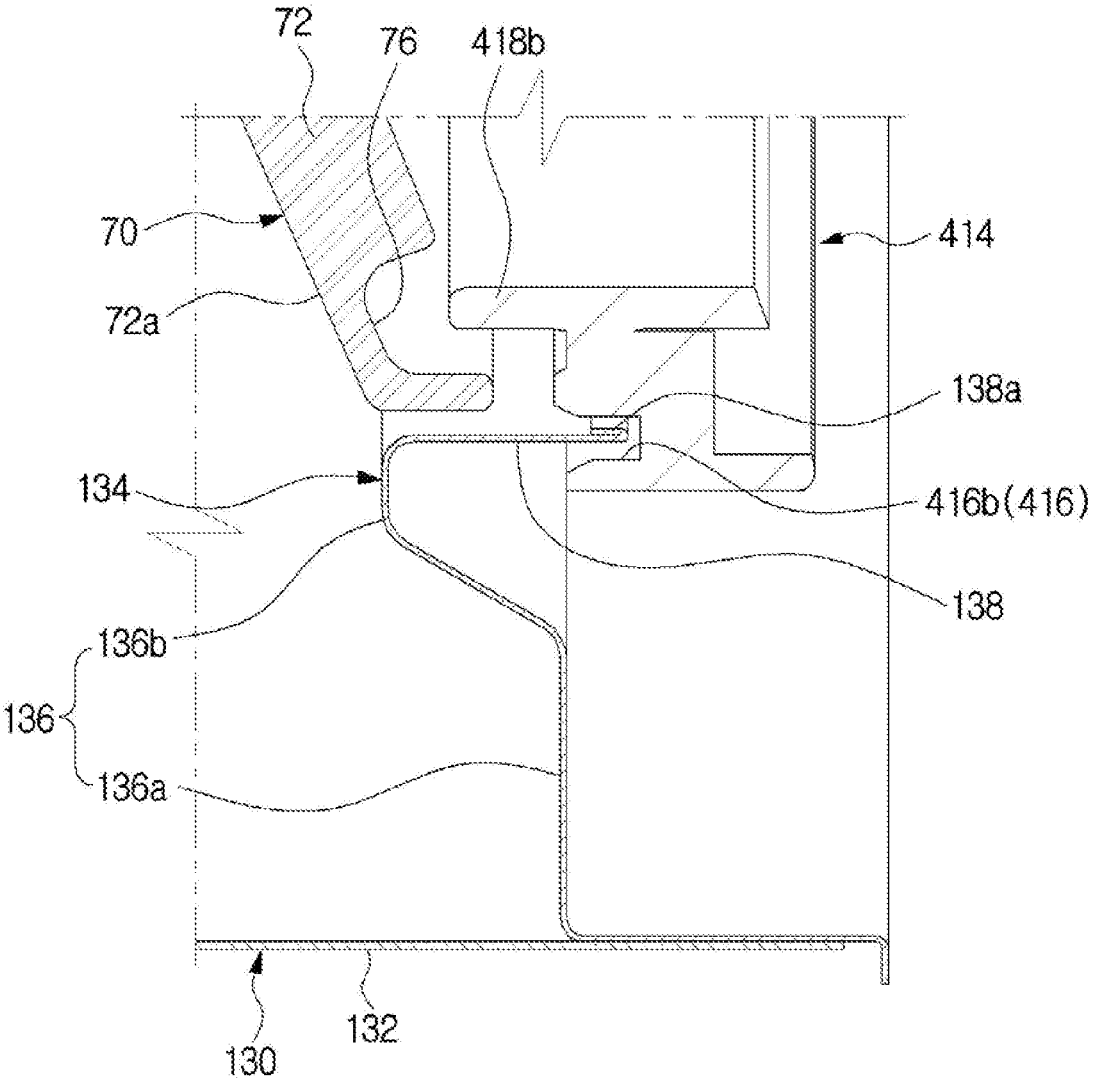
FIG. 18 is an enlarged view illustrating D of FIG. 16.

FIG. 13 is an exploded-perspective view illustrating a part of a washing machine in accordance with another embodiment, FIGS. 14 and 15 are views illustrating a flange shaft of the washing machine in accordance with another embodiment, FIG. 16 is a view illustrating coupling of a drum, the flange shaft, and a pulsator of the washing machine in accordance with another embodiment, FIG. 17 is an enlarged view illustrating C of FIG. 16, and FIG. 18 is an enlarged view illustrating D of FIG. 16.

A flange shaft 400 may include a flange body 410, a plurality of blades 412 and a seating member 414. A plurality of blades 412 may include a coupling portion 413 formed in an end portion of the blade and coupled to the drum 130.

The seating member 414 is provided to connect the plurality of blades 412 to each other. The seating member 414 may be formed in a substantially ring shape. Since the seating member 414 is provided to connect the plurality of blades 412 to each other, the seating member 414 may support the plurality of blades 412 in the circumferential direction. That is, the seating member 414 may stably support the plurality of blades 412 in the circumferential direction. The seating member 414 may be configured to be detachable from the plurality of blades 412. The seating member 414 may be fixed to the plurality of blades 412 through a screw, or alternatively, the seating member 414 may be fixed to the plurality of blades 412 through a separate member. The seating member 414 may form a coupling groove 414*a* to which the plurality of blades 412 is coupled. The plurality of blades 412 may be inserted and coupled to the coupling groove 414*a* and thus a first and second seating groove 416*a* and 416*b* may be positioned at the same height. However, the coupling method of the seating member 414 is not limited thereto.

The flange shaft 400 may include a seating groove 416.

The seating groove 416 may be configured to allow one side of the rear cover 134 to be seated. The seating groove 416 may include a first and second seating groove 416*a* and 416*b*. The first seating groove 416*a* may be formed in the plurality of blades 412 and the second seating groove 416*b* may be formed in the seating member 414. The first and second seating grooves 416*a* and 416*b* may be formed in a circular shape.

The flange shaft 400 may include a flange protrusion 418.

The flange protrusion 418 may protrude toward the rear side of the pulsator 70. The pulsator 70 may include a pulsator groove 76 in which the flange protrusion 418 is inserted into the rear surface thereof. When the pulsator 70 and the drum 130 are installed with respect to the same rotation axis, the flange protrusion 418 may be inserted into the pulsator groove 76. The flange protrusion 418 and the pulsator groove 76 may prevent the foreign material or the laundry inside the drum 130 from entering into the rear side of the pulsator 70. The flange protrusion 418 may be spaced apart from the inner surface of the pulsator groove 76 by a predetermined distance so that the rotation of the pulsator 70 is not interfered with the flange protrusion 418. The flange protrusion 418 may include a first flange protrusion 418*a* formed in the plurality of blades 412 and a second flange protrusion 418*b* formed in the seating member 414.

As is apparent from the above description, it may be possible to improve the washing efficiency by applying a pulsator structure to a drum type washing machine.

It may be possible to stably support the rotation of a drum by improving a coupling structure between the drum and a flange shaft.

It may be possible to prevent the rotation of the drum and the rotation pulsator from being interfered with each other.

It may be possible to prevent the deformation of the drum caused by the impact upon the rotation of the laundry in the drum.

It may be possible to prevent the laundry from being caught between the pulsator and the drum when the drum is rotated.

Although a few embodiments of the present disclosure have been shown and described, it would be appreciated by those skilled in the art that changes may be made in these embodiments without departing from the principles and spirit of the disclosure, the scope of which is defined in the claims and their equivalents.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A washing machine comprising:

a cabinet;

a tub provided in the cabinet to store washing water;

a drum rotatably provided in the tub about a rotation axis, the drum comprising a cylindrical portion configured to form a side surface of the drum;

a pulsator configured to be rotatable about the rotation axis independently of the drum and having a radius equal to a distance from the rotation axis to an outer edge of the pulsator; and a flange shaft mounted to the cylindrical portion of the drum and configured to transmit a rotational force to the drum, including a seating groove located at a radius of the flange shaft outside of the radius of the pulsator, wherein the drum comprises a rear cover disposed in one side of the cylindrical portion, the rear cover comprising a seating flange on an innermost circumferential surface of the rear cover disposed outside of the radius of the pulsator and seated in the seating groove.

2. The washing machine of claim 1, wherein:

the ear cover comprises a drum rear surface configured to form a rear surface of the drum, and the seating flange is bent from the drum rear surface to be seated in the seating groove.

3. The washing machine of claim 2, wherein:

the flange shaft comprises:

a flange body coupled to a shaft configured to transmit power from a drive device, a plurality of blades extended radially from the flange body, and a seating member configured to connect the plurality of blades to each other, and the seating flange is seated in at least one of the plurality of blades and the seating member.

4. The washing machine of claim 3, wherein the seating groove is formed in at least one of the plurality of blades and the seating member and into which the seating flange is inserted.

5. The washing machine of claim 4, wherein:

the seating groove comprises:

a first seating groove formed in the plurality of blades, and a second seating groove formed in the seating member, and the first and second seating groove are formed in a circular shape with respect to a center of rotation of the drum.

6. The washing machine of claim 4, wherein the seating flange comprises an insertion rib formed to have a greater thickness than a body of the seating flange and configured to be inserted into the seating groove.

7. The washing machine of claim 6, wherein the insertion rib is formed by a hemming structure in which an end portion of the seating flange is folded.

8. The washing machine of claim 3, wherein the seating member connects the plurality of blades to each other and supports the plurality of blades in a circumferential direction.

9. The washing machine of claim 8, wherein the plurality of blades and the seating member are integrally formed.

10. The washing machine of claim 8, wherein the seating member is formed in a ring shape and detachable from the plurality of blades.

11. The washing machine of claim 2, wherein the seating flange comprises a seating rib formed such that an end portion of the seating flange is bent so as to be in contact with the flange shaft.

12. The washing machine of claim 2, wherein the seating flange forms a separation space with an outer circumferential surface of the pulsator to be disposed to face the outer circumferential surface of the pulsator.

13. The washing machine of claim 2, wherein:

the drum rear surface comprises:

a first drum rear surface extended from the cylindrical portion, and a second drum rear surface protruded from the first drum rear surface toward a front side of the drum to be connected to the seating flange, and the second drum rear surface disposed in parallel with a front surface of the pulsator.

14. The washing machine of claim 1 wherein:

the flange shaft comprises a flange protrusion protruded toward a rear surface of the pulsator, and the pulsator comprises a pulsator groove configured to allow the flange protrusion to be inserted thereto.

15. The washing machine of claim 14, wherein the flange protrusion and the pulsator groove are formed in a circular shape.

16. A washing machine comprising:

a cabinet;

a tub provided in the cabinet to store washing water;

a drum having a cylindrical portion and a rear cover provided in one side of the cylindrical portion and configured to be rotatably provided in the tub about a rotation axis;

a pulsator configured to be rotatable about the rotation axis independently of the drum, having a radius equal to a distance from the rotation axis to an outer edge of the pulsator, and configured to be surrounded by an inner circumferential surface of the rear cover; and a flange shaft mounted to the cylindrical portion of the drum to transmit a rotational force to the drum in a rear side of the pulsator, including a seating groove located at a radius of the flange shaft outside of the radius of the pulsator, and configured to allow the rear cover to be inserted into the seating groove, wherein the rear cover comprises a seating flange on an innermost circumferential surface of the rear cover disposed outside of the radius of the pulsator and seated in the seating groove.

17. The washing machine of claim 16, wherein:

the rear cover comprises a drum rear surface configured to form a rear surface of the drum, and the seating flange is bent from the drum rear surface to be inserted into the seating groove.

18. The washing machine of claim 17, wherein:

the flange shaft comprises:

a flange body coupled to a shaft configured to transmit power from a drive device, a plurality of blades extended radially from the flange body, and a seating member configured to connect the plurality of blades to each other, and the seating flange is seated in at least one of the plurality of blades and the seating member.

19. The washing machine of claim 18, wherein the seating groove formed in at least one of the plurality of blades and the seating member and is configured to allow the seating flange to be inserted thereto.

20. A washing machine comprising:

a cabinet;

a tub provided in the cabinet to store washing water;

a drum configured to be rotatably provided in the tub with respect to a rotation shaft, and provided with a cylindrical portion, and a rear cover provided in a rear side of the cylindrical portion and extended toward the rotation shaft;

a pulsator configured to be rotatable independently of the drum about the rotation shaft in the drum, having a radius equal to a distance from the rotation shaft to an outer edge of the pulsator, and disposed in an inner side of the rear cover; and a flange shaft provided with a seating groove located at a radius of the flange shaft outside of the radius of the pulsator to which the rear cover is inserted, the flange shaft mounted to the cylindrical portion of the drum and configured to transmit a rotational force to the drum, wherein the rear cover comprises a seating flange on an innermost circumferential surface of the rear cover disposed outside of the radius of the pulsator and seated in the seating groove.

* * * * *